US010000972B2

(12) United States Patent
Gaikwad et al.

(10) Patent No.: US 10,000,972 B2
(45) Date of Patent: Jun. 19, 2018

(54) DOWNHOLE ADJUSTABLE BENT MOTOR

(71) Applicant: HALLIBURTON ENERGY SERVICES, INC., Houston, TX (US)

(72) Inventors: Rahul Ramchandra Gaikwad, Solapur (IN); Ravi Kiran Kundam, Hyderabad (IN); Ragi Lohidakshan Poyyara, Pune (IN); Krunal Kanubhai Mehta, Valsad (IN)

(73) Assignee: HALLIBURTON ENERGY SERVICES, INC., Houston, TX (US)

( * ) Notice: Subject to any disclaimer, the term of this patent is extended or adjusted under 35 U.S.C. 154(b) by 257 days.

(21) Appl. No.: 14/899,057

(22) PCT Filed: Aug. 29, 2013

(86) PCT No.: PCT/US2013/057332

§ 371 (c)(1),
(2) Date: Dec. 16, 2015

(87) PCT Pub. No.: WO2015/030776

PCT Pub. Date: Mar. 5, 2015

(65) Prior Publication Data

US 2016/0123083 A1 May 5, 2016

(51) Int. Cl.

| | |
|---|---|
| ***E21B 17/20*** | (2006.01) |
| ***E21B 4/02*** | (2006.01) |
| ***E21B 7/06*** | (2006.01) |

(52) U.S. Cl.

CPC ..... *E21B 7/067* (2013.01); *E21B 4/02* (2013.01); *E21B 17/20* (2013.01)

(58) Field of Classification Search

CPC ..... E21B 7/067; E21B 4/02; E21B 17/20
See application file for complete search history.

(56) References Cited

U.S. PATENT DOCUMENTS

| | | | |
|---|---|---|---|
| 3,743,034 | A | 7/1973 | Bradley |
| 4,067,404 | A | 1/1978 | Crase |
| 4,522,272 | A | 6/1985 | Beimgraben |
| 4,974,688 | A | 12/1990 | Helton |

(Continued)

OTHER PUBLICATIONS

International Search Report and Written Opinion for PCT/US2013/057332 dated May 19, 2014; 14 pages; Korean Intellectual Property Office, International Searching Authority.

*Primary Examiner* — D. Andrews
*Assistant Examiner* — Brandon M Duck

(57) ABSTRACT

A bent sub for use in a bottom hole assembly, between the power section of a mud motor and the drill bit, which can have its bend angle altered from the surface while remaining downhole, and a method for adjusting the bend of a bent sub. A biasing mechanism includes a number of linear actuators radially positioned about the tool centerline and oriented for axial motion. The linear actuators are connected to travelling blocks, which engage the upper end of the inner race a pivoting bearing assembly. The lower end of the inner race is connected to the mud motor bearing assembly. The linear actuators and can be actuated in coordination to tilt the inner race, and hence, the mud motor bearing assembly, to various selectable angles in any radial direction for control of tool face. In an embodiment, the actuators are battery-powered motor-driven lead screws.

20 Claims, 6 Drawing Sheets

(56) References Cited

U.S. PATENT DOCUMENTS

| | | | | |
|---|---|---|---|---|
| 5,220,963 | A | 6/1993 | Patton | |
| 5,899,281 | A | 5/1999 | Gynz-Rekowski | |
| 6,109,372 | A | 8/2000 | Dorel et al. | |
| 6,158,529 | A | 12/2000 | Dorel | |
| 6,554,083 | B1 | 4/2003 | Kerstetter | |
| RE39,970 | E | 1/2008 | Askew | |
| 7,882,904 | B2 | 2/2011 | von Gynz-Rekowski et al. | |
| 7,946,361 | B2 | 5/2011 | Gurjar et al. | |
| 2001/0052428 | A1* | 12/2001 | Larronde | E21B 7/062 175/61 |
| 2011/0100716 | A1 | 5/2011 | Shepherd | |
| 2012/0043133 | A1* | 2/2012 | Millet | E21B 7/067 175/55 |
| 2013/0319764 | A1* | 12/2013 | Schaaf | E21B 7/06 175/24 |
| 2013/0341099 | A1* | 12/2013 | Gillis | E21B 4/003 175/92 |

* cited by examiner

DOWNHOLE ADJUSTABLE BENT MOTOR

CROSS REFERENCE TO RELATED APPLICATIONS

The present application is a U.S. National Stage patent application of International Patent Application No. PCT/US2013/057332, filed on 29 Aug. 2013, the benefit of which is claimed and the disclosure of which is incorporated herein by reference in its entirety.

TECHNICAL FIELD

The present disclosure relates generally to oilfield equipment, and in particular to downhole tools.

BACKGROUND

A steerable drilling system is used to drill a deviated borehole from a straight section of a wellbore. Steerable drilling systems conventionally use a downhole motor (mud motor) powered by drilling fluid pumped from the surface to rotate the drill bit. Most commonly, a positive displacement motor of the Moineau type, which uses a spiraling rotor that is driven by fluid pressure passing between the rotor and stator, is employed. Such mud motors are capable of producing high torque, low speed drilling that is generally desirable for steerable applications.

In an example implementation, the motor and bit are supported from a drill string that extends to the well surface. The motor is operable to rotate the bit via a constant velocity (CV) drive linkage that extends through a bent sub or bent housing positioned between the power section of the motor and a bearing assembly of the motor. In addition to accommodating power transmission over the bend angle, the CV linkage allows for the spiraling nutation of the power section of the mud motor.

Bent housings (fixed or adjustable) are used as part of the mud motor to alter the direction of the drill bit drilling a wellbore. Usually the bent housing will move the tool face, i.e., the face of the drill bit that is engaging the formation, from 1 to 5 degrees off of the centerline of the drill string and wellbore, thereby causing a change in the direction of the wellbore.

Rotary drilling, wherein the drill string is rotated from the rig at the surface, is used to drill the straight sections of the borehole. The mud motor and bent sub are rotated with the drill string, resulting is a slightly enlarged borehole to be drilled. To steer the bit, however, the operator holds the drill string from rotation and powers the downhole motor to rotate the bit. The non-rotating drill string and mud motor assembly slide forward along the borehole during penetration. During this sliding operation, the bend directs the bit away from the axis of the borehole to provide a slightly curved borehole section, with the curve achieving the desired deviation or build angle.

Mud motors generally consists of a bent housing whose bend angle cannot be controlled while downhole. In order to change the inclination of the bent housing, it is necessary to pull the bent housing from the borehole (called "tripping out") to change the inclination setting. Tripping out of borehole increases nonproductive time. It is desirable to have a system or a mechanism that allows the operator to change the inclination of the bent housing while downhole.

BRIEF DESCRIPTION OF THE DRAWINGS

Embodiments are described in detail hereinafter with reference to the accompanying figures, in which.

DETAILED DESCRIPTION

Figure 1:
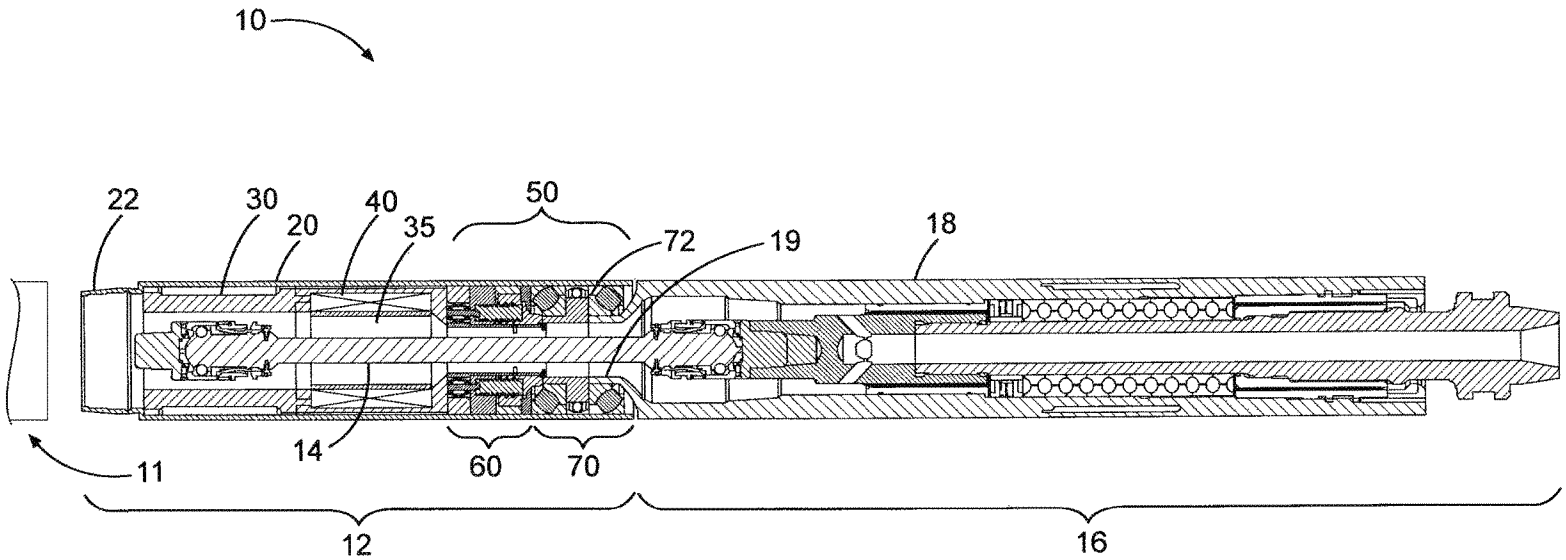
FIG. 1 is an axial cross section of a surface-actuated downhole-adjustable mud motor bent sub and a lower bearing section according to a preferred embodiment, showing an adjustable bent section, presently set with a zero-degree bend, with a constant velocity joint shaft therein for connection beneath an upper power section of a mud motor.
Figure 2:
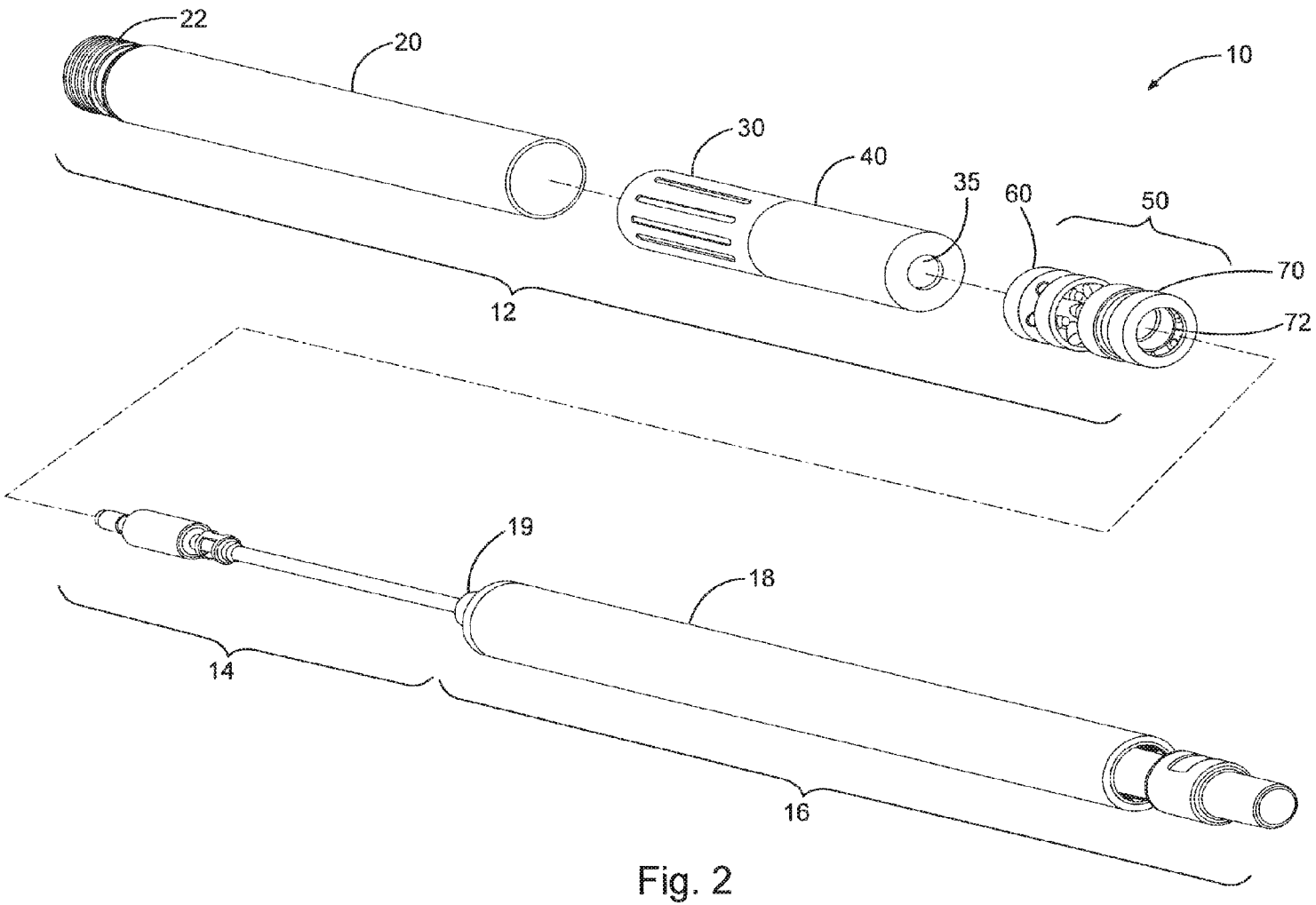
FIG. 2 is a perspective exploded diagram of the bent section and a lower bearing section of FIG. 1, showing a battery assembly, an electronic control assembly, and a biasing unit consisting of a linear actuator assembly and a pivotal bearing assembly, contained in the adjustable bent section.

FIGS. 1 and 2 illustrate the surface actuated downhole-adjustable mud motor 10 according to a preferred embodiment. In particular, the figures illustrate the adjustable bent section 12 with the constant velocity shaft assembly 14 and the lower bearing section 16. Elements of a conventional mud motor power section 11 may be included but are not explicitly detailed in FIG. 1. A suitable example of a mud motor includes a positive displacement Moineau motor, although other power sections, including turbine motors, may be used as appropriate. The mud motor power section 11 and the constant velocity shaft assembly 14 may be of ordinary design and construction as known to routineers in the art.

Bent section 12 includes a cylindrical housing 20 having an upper threaded pin connector 22 for connection to the stator (not illustrated) of the mud motor power section 11. Into housing 20, a tubular battery assembly 30 and a tubular electronic control assembly 40 is received. Battery assembly 39 and electronic control assembly 40 define a hollow axial conduit 35 that accommodates the flow of drilling fluid through the tool and constant velocity shaft assembly 14, with sufficient clearance for the expected nutation and range of bend angles. Battery assembly 30 and electronic control assembly 40 power and control a number of electrical linear actuators in the biasing unit 50, as is described in greater detail below.

Biasing unit 50 includes a linear actuator assembly 60 acts on a pivotal bearing assembly 70. The lower bearing section 16 is substantially of conventional design and construction, except that it is connected to the adjustable bent section 12 solely via the inner race 72 of pivotal bearing assembly 70 rather than to housing 20, as typical. In a particular embodiment, lower bearing section 16 includes a lower bearing housing 18, which has an upper end 19 characterized by a necked-down diameter which is threaded or otherwise connected to the inner race 72.

Figure 3A:
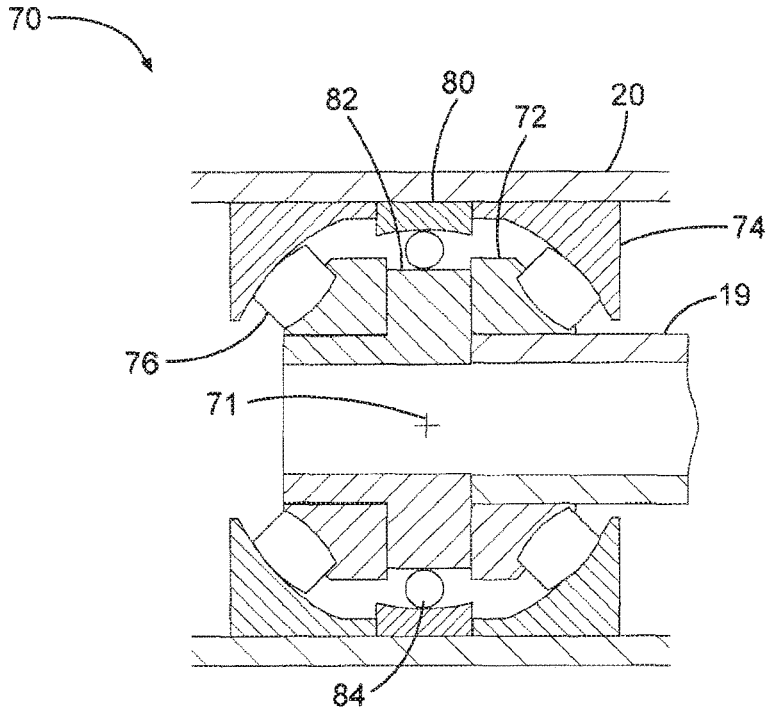
FIG. 3A is an enlarged axial cross section of the pivotal bearing assembly of the bent section biasing unit of FIGS. 1 and 2, showing inner and outer races in axial alignment.
Figure 3B:
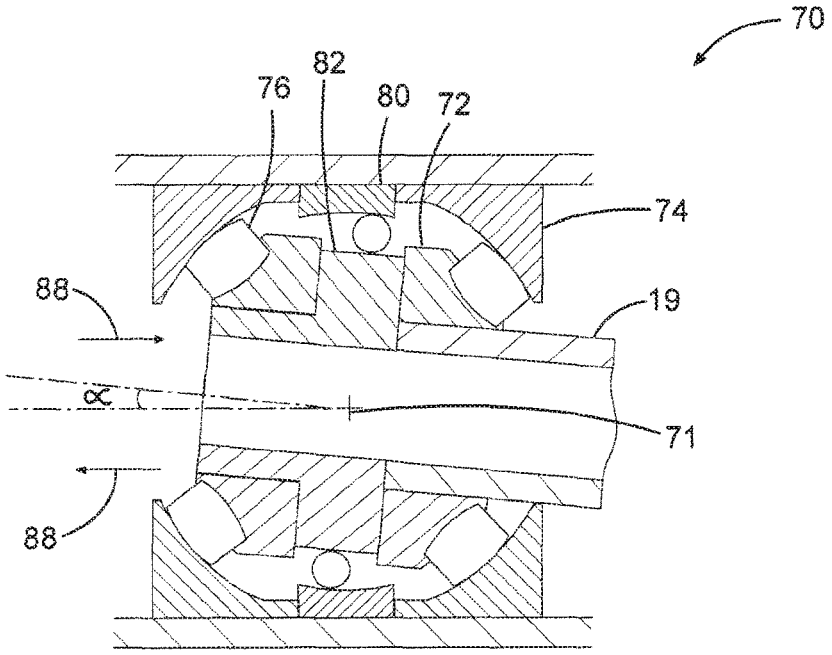
FIG. 3B is an enlarged axial cross section of the pivotal bearing assembly of FIG. 3A, showing inner and outer races in axial misalignment for creating a bend angle between the bent section and the lower bearing section of FIGS. 1 and 2.
Figure 4:
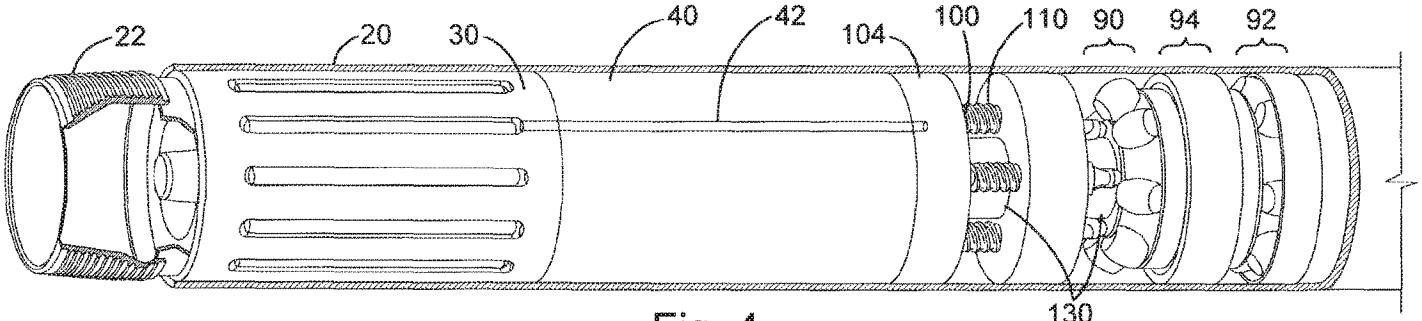
FIG. 4 is a perspective view of a the biasing unit of the downhole tool of FIG. 1 shown with the housing cut away to reveal the internal components, including linear actuators, a travelling block, and a bearing assembly.
Figure 5:
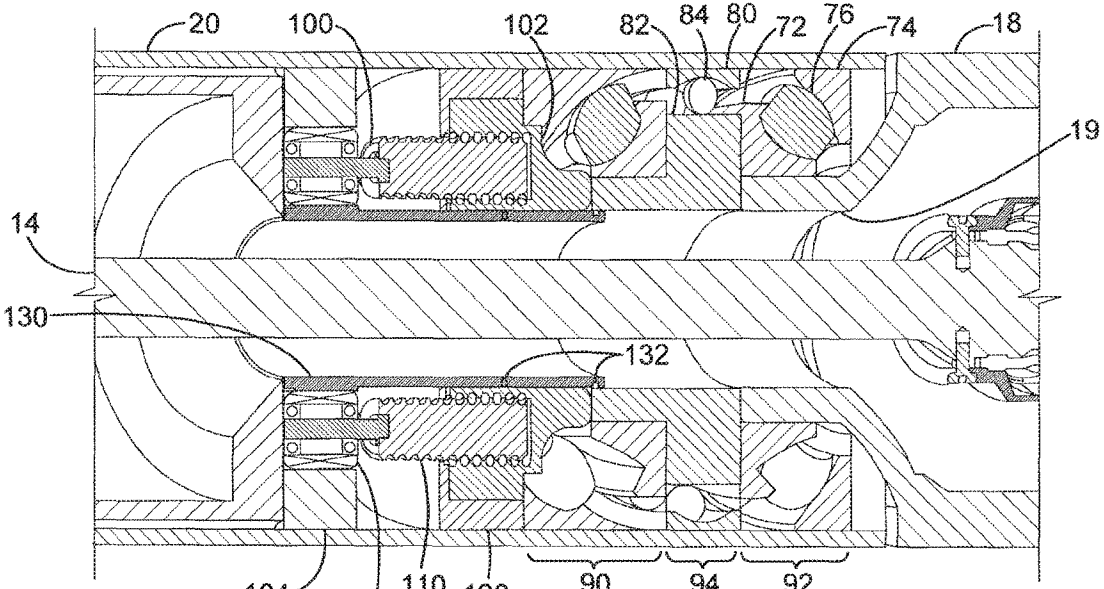
FIG. 5 is an enlarged perspective view in axial cross section of the linear actuators, travelling block, and bearing assembly of FIG. 4.
Figure 6:
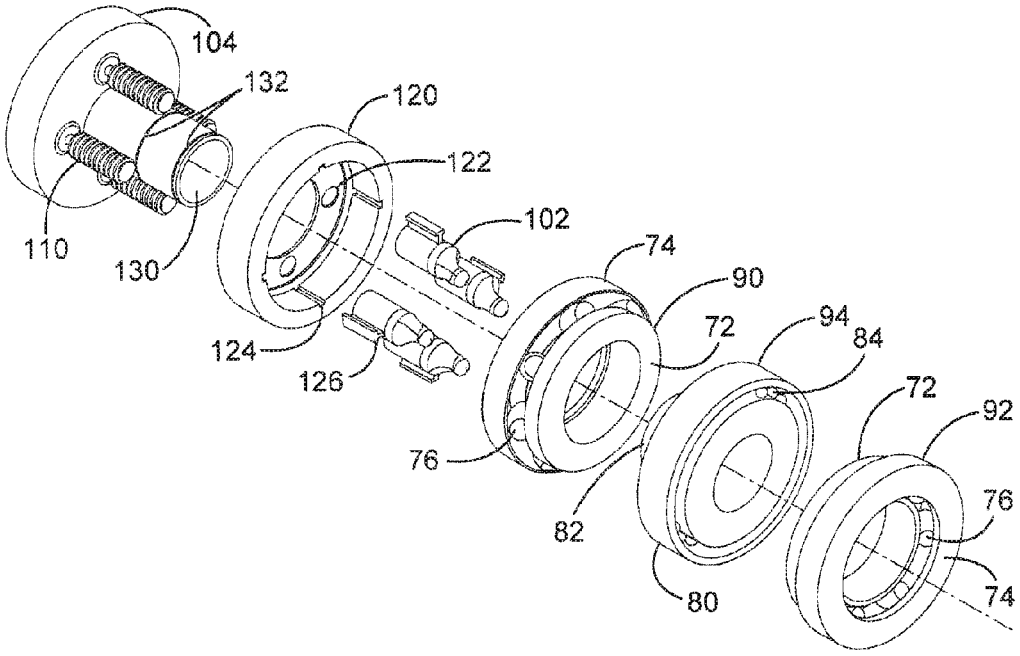
FIG. 6 is an exploded diagram of the biasing unit of FIGS. 4 and 5 from the bottom perspective, showing a pivotal bearing assembly including upper and lower roller thrust bearings and a central radial ball bearing, electric motors held within a motor unit ring for rotating lead screws, independent travelling blocks that ride on the lead screws and engage the inner race of the radial ball bearing, and a travelling block ring with slots for preventing the travelling blocks from rotating as the lead screws rotate.
Figure 7:
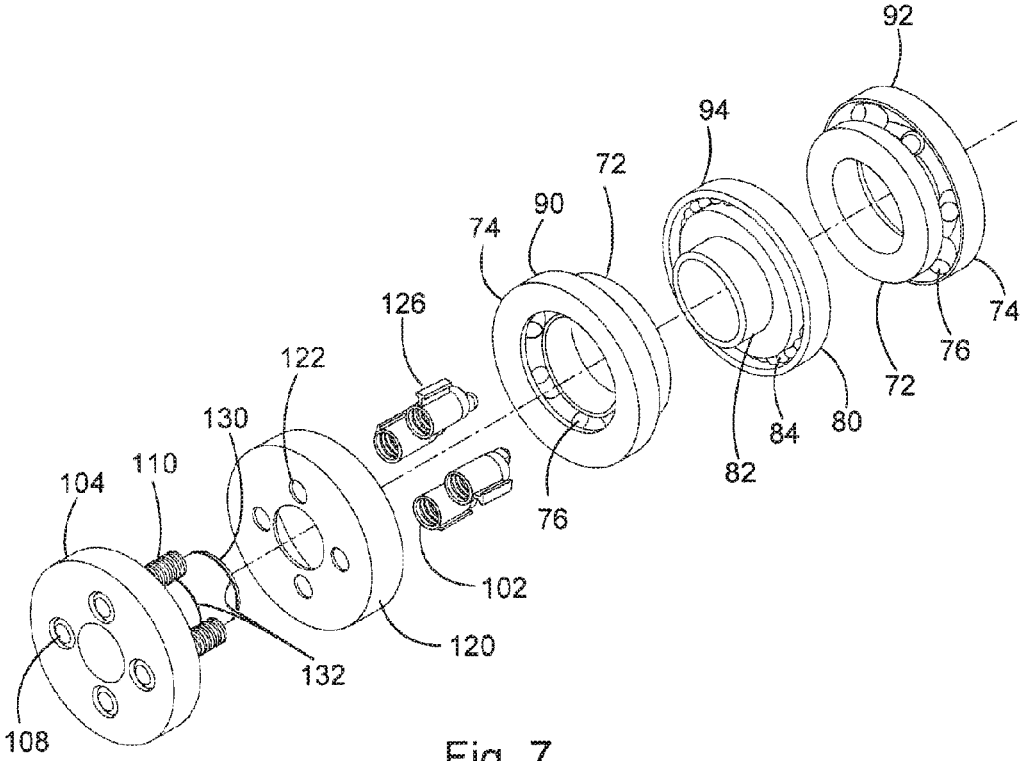
FIG. 7 is an exploded diagram of the biasing unit of FIG. 6 from the top perspective.

FIGS. 3A and 3B explain the operation of pivotal bearing assembly 70 according to a preferred embodiment. In essence, pivotal bearing assembly 70 is a spherical bearing assembly that includes an outer race 74 having a spherical profile at a radius about a center point 71, in which operates two rows of barrel-shaped rollers 76. The barrel-shaped rollers 76 are in turn guided by inner race 72. Spherical roller bearings have a large capacity for both radial loads and axial loads in either direction. An optional radial bearing, including outer race 80, inner race 82, and a row of balls 84, may be included between the upper and lower rows of barrel-shaped rollers 76. As with outer race 74, outer race 80 has a profile that is spherical about center point 71. A cage may or may not be used to guide rollers 76 and balls 84, as is known in the art of bearing design. Similarly, other bearing configurations, including the overall design and configuration of inner and outer races, may be used as appropriate, provided the bearing provides for limited misalignment between the inner and outer rings and withstands required axial and radial loads.

Outer races 74 and 80 are pressed within housing 20. The upper end 19 of lower bearing housing 18 is fixed to inner races 72 and 82. In FIG. 3A, the inner race 72 and outer race 74 are aligned, so that lower bearing housing 18 is coaxially aligned with bent section cylindrical housing 20. In FIG. 3B, linear actuator assembly 60 (FIGS. 1 and 2) acts on inner races 72, 82 in the directions indicated by arrows 88 to cause lower bearing housing 18 to be bent an angle $\alpha$ with respect to bent section cylindrical housing 20.

Although pivotal bearing assembly 70 as described above allows relative rotation between bent section housing 20 and lower bearing housing section 19, in an alternate embodiment, a bearing assembly may be provided that allows only articulation between bent section housing 20 and lower bearing housing section 19 without rotation.

Referring now to FIGS. 4-7, biasing unit 50 includes pivotal bearing assembly 70, as described above. In the particular embodiment illustrated, pivotal bearing assembly 70 includes upper and lower spherical roller thrust bearings 90, 92, respectively, and a central spherical ball radial bearing 94. The outer race 74 of upper thrust bearing 90 is omitted from FIG. 4 to reveal the interaction of the linear actuator assembly 60 with the inner race 82 of the radial bearing assembly, as described below. The inner race 72 of lower thrust bearing 92 is connected to lower bearing housing 18 via upper neck portion 19.

Linear actuator assembly 60 acts on the inner race 82 of radial bearing 94, which causes inner race 72 of lower thrust bearings 90, 92, upper neck portion 19, and lower bearing housing 18 to pivot. Linear actuator assembly 60 includes one, but ideally several, linear actuators 100 radially positioned about the tool centerline and oriented for axial motion. The linear actuators are each adapted to move a travelling block 102, which abuts and transfers axial force on inner race 82. In a preferred embodiment, the distance from the top of tool 10 to the point where the travelling block engages 102 the inner race 82 is less than the distance measured from the top of tool 10 to the pivot point of the pivotal bearing assembly 70. In other words, the linear actuators act above the pivot point as a class 1 lever to tilt the lower housing.

Each actuator 100 is individually controlled to alter the relative position of its associated travelling block 102, and hence, the bend of tool 10. Linear actuators 100 receive power from battery assembly 30 and control signals from electronic control assembly 40 via wires running through one or more wiring slots 42 (FIG. 4) provided battery assembly 30, electronic control assembly 40, and motor unit ring 104. In a preferred embodiment, electronic control assembly 40 continuously monitors current tool face data. In the event of any tool face change requirements, electronic control assembly 40 sends control signals to the individual actuators 100 to achieve the desired tool face.

With three or more linear actuators 100 , both the direction of inclination as well as the angle of inclination can be controlled by the system of the invention. A single actuator 100 may be used, although such a configuration minimizes the control an operator can have over the direction of the inclination. In the embodiment illustrated, four linear actuators 100 are used. Although four screws and travel blocks are illustrated, in other embodiments, a different number may be used, with larger numbers increasing the operator's control over the direction of the inclination.

In a preferred embodiment, each linear actuator 100 consists generally of an electric motor 108 that rotates a lead screw 110. Travelling block 102 is threaded and travels on lead screw 110 as motor 108 is rotated. Electric motors 108 are preferably mounted in a motor unit ring 104. A travelling block ring 120 is positioned below motor unit ring 104. Travelling block ring 120 includes holes 122 formed therethrough through which lead screws 110 pass. The interior wall of travelling block ring 120 has slots 124 formed therein, and travelling blocks 102 have complementary axial ribs 126 that slide within slots 124 for preventing the travelling blocks 102 from rotating as the lead screws 110 rotate.

Although electric motors 108 and lead screws 110 are illustrated, in other embodiments, other types of linear actuators 100 may be used, as known to routineers in the mechanical arts.

An inner sleeve 130 with O-rings or like seals 132 is provided within motor unit ring 104, travelling block ring 120, and inner race 82 channel drilling fluid and prevent it from linear actuator assembly 60.

Figure 8:
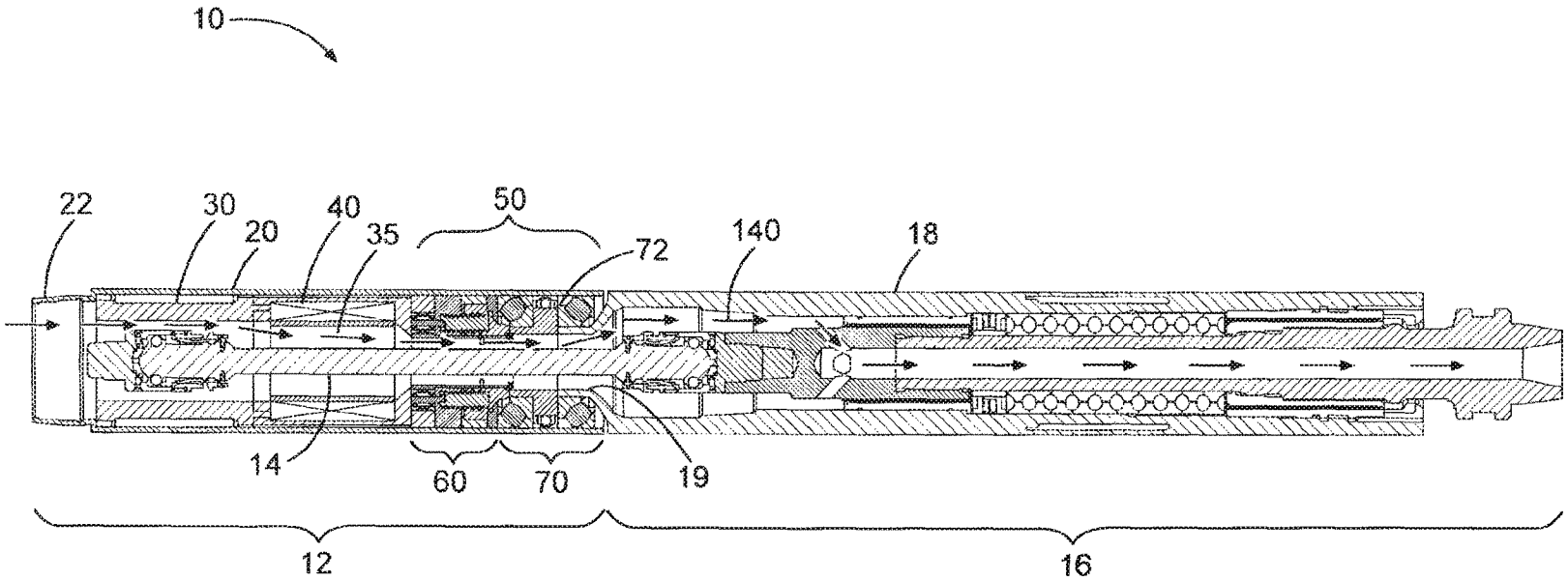
FIG. 8 is an axial cross section of a surface-actuated downhole-adjustable mud motor bent sub and a lower bearing section of FIG. 1, showing the drilling fluid flow path therethrough.

FIG. 8 is an axial cross section of a surface-actuated downhole-adjustable mud motor bent sub and a lower bearing section of FIG. 1, with arrows 140 showing the drilling fluid flow path therethrough.

The Abstract of the disclosure is solely for providing the United States Patent and Trademark Office and the public at large with a way by which to determine quickly from a cursory reading the nature and gist of technical disclosure, and it represents solely one or more embodiments.

While various embodiments have been illustrated in detail, the disclosure is not limited to the embodiments shown. Modifications and adaptations of the above embodiments may occur to those skilled in the art. Such modifications and adaptations are in the spirit and scope of the disclosure.

What is claimed is:

1. A downhole-adjustable bent tool for connecting to a drill string, comprising:

a cylindrical first housing defining a first longitudinal axis;

a cylindrical second housing defining a second longitudinal axis;

a bearing assembly including an inner race and an outer race, said outer race connected to said first housing, said inner race connected to said second housing, said bearing assembly including a pivotable connection between said inner and outer races whereby said second housing can be pivoted with respect to said first housing about an axis perpendicular to said first longitudinal axis;

a plurality of linear actuators radially disposed about said first longitudinal axis, oriented for motion parallel to said first longitudinal axis, and operatively coupled to said inner race for applying an axial force thereto, wherein each of said plurality of linear actuators includes an electric motor coupled to a lead screw for selective rotation thereof and a travelling block threaded to said lead screw for linear translation, and wherein said plurality of travelling blocks engage said inner race, the plurality of actuators including a first linear actuator fixed within said first housing at a first radial distance from said first longitudinal axis and oriented for motion parallel to said first longitudinal axis, said first linear actuator operatively coupled to said inner race for applying an axial force thereto so that actuation of said first linear actuator pivots said second housing with respect to said first housing; and an electronic control assembly designed and arranged for providing coordinated actuation of said plurality of linear actuators to tilt said second housing with respect to said first housing a user-selectable angle in a user-selectable direction.

2. The tool of claim 1 wherein:

said bearing assembly includes a radial bearing; and said first linear actuator abuts said radial bearing.

3. The tool of claim 1 wherein each of said plurality of linear actuator further comprises:

a rail and a slot coupled between said travelling block and said first housing, said rail being dimensioned to slide within said slot; whereby each travelling block is prevented from rotating with its respective said lead screw.

4. The tool of claim 3 further comprising:

a travelling block ring defining an interior cylindrical wall having said plurality of slots formed therein.

5. The tool of claim 1 further comprising:

a constant velocity shaft assembly disposed within said first housing;

a mud motor power section coupled to an upper end of said first housing; and a mud motor lower bearing section disposed within said second housing.

6. The tool of claim 1 wherein:

said bearing assembly defines a pivot point;

said first housing is positioned above said second housing; and a point at which said first linear actuator engages said inner race is located above said pivot point.

7. The tool of claim 1 further comprising:

a battery assembly located within said first housing and electrically coupled to said first linear actuator for powering said first linear actuator.

8. The tool of claim 1 wherein:

said bearing assembly is a spherical bearing assembly.

9. The tool of claim 1 wherein:

said bearing assembly includes first and second thrust bearings.

10. A method for adjusting the bend of a bent sub comprising:

providing a bent sub having a cylindrical first housing defining a first longitudinal axis, a cylindrical second housing defining a second longitudinal axis, a bearing assembly defining an inner race and an outer race, said bearing assembly permitting pivoting about a pivot point between said inner and outer races, said outer race connected to said first housing, said inner race connected to said second housing, whereby said second housing can be pivoted with respect to said first housing about an axis perpendicular to said first longitudinal axis;

applying an axial force to said inner race at a first radial distance from said first longitudinal axis to pivot said second housing with respect to said first housing;

providing a plurality of linear actuators radially disposed about said first longitudinal axis, oriented for motion parallel to said first longitudinal axis, and operatively coupled to said inner race for applying an axial force thereto, wherein each of said plurality of linear actuators includes an electric motor coupled to a lead screw for selective rotation thereof and a travelling block threaded to said lead screw for linear translation and said plurality of travelling blocks engage said inner race;

providing an electronic control assembly designed and arranged for coordinated actuation of said plurality of linear actuators; and controlling said plurality of linear actuators with said electronic control assembly to tilt said second housing with respect to said first housing a user-selectable angle in a user-selectable direction.

11. The method of claim 10 wherein each of said plurality of linear actuators further comprises:

a rail and a slot coupled between said travelling block and said first housing, said rail being dimensioned to slide within said slot; whereby each travelling block is prevented from rotating with its respective said lead screw.

12. The method of claim 11 further comprising:

providing a travelling block ring defining an interior cylindrical wall having said plurality of slots formed therein.

13. The method of claim 10 further comprising:

providing a constant velocity shaft assembly disposed within said first housing;

providing a mud motor power section coupled to an upper end of said first housing; and providing a mud motor lower bearing section disposed within said second housing; and adjusting the bend angle between said power section and said lower bearing section.

14. The method of claim 10 further comprising:

positioning said first housing above said second housing; and engaging said inner race by said plurality of linear actuators at a point above said pivot point of said bearing assembly.

15. The method of claim 10 further comprising:

providing a battery assembly within said first housing; and powering said plurality of linear actuators by said battery assembly.

16. A downhole-adjustable bent tool for connecting to a drill string, comprising:

a cylindrical first housing defining a first longitudinal axis;

a cylindrical second housing defining a second longitudinal axis;

a bearing assembly including an inner race and an outer race, said outer race connected to said first housing, said inner race connected to said second housing, said bearing assembly including a pivotable connection between said inner and outer races whereby said second housing can be pivoted with respect to said first housing about an axis perpendicular to said first longitudinal axis;

an electric motor;

a lead screw coupled to the electric motor and selectively rotatable thereby, the lead screw disposed at a first radial distance from said first longitudinal axis;

a traveling block engaging the inner race and threaded to said lead screw for linear translation parallel to said first longitudinal axis upon rotation of the lead screw; and an electronic control assembly for providing actuation of said electric motor to tilt said second housing with respect to said first housing a user-selectable angle in a user-selectable direction.

17. The tool of claim 16, further comprising a rail and a slot coupled between said travelling block and said first housing, said rail being dimensioned to slide within said slot.

18. The tool of claim 16, a battery assembly located within said first housing and electrically coupled to said electric motor.

19. The tool of claim 16 further comprising:

a constant velocity shaft assembly disposed within said first housing;

a mud motor power section coupled to an upper end of said first housing; and a mud motor lower bearing section disposed within said second housing.

20. The tool of claim 16 wherein said bearing assembly is a spherical bearing.

* * * * *